US009896307B2

(12) United States Patent
Mitsui

(10) Patent No.: US 9,896,307 B2
(45) Date of Patent: Feb. 20, 2018

(54) ELEVATOR ROPE AND ELEVATOR APPARATUS THAT USES SAME

(71) Applicant: MITSUBISHI ELECTRIC CORPORATION, Chiyoda-ku (JP)

(72) Inventor: Atsushi Mitsui, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 0 days.

(21) Appl. No.: 14/903,840

(22) PCT Filed: Jul. 9, 2013

(86) PCT No.: PCT/JP2013/068737
§ 371 (c)(1),
(2) Date: Jan. 8, 2016

(87) PCT Pub. No.: WO2015/004729
PCT Pub. Date: Jan. 15, 2015

(65) Prior Publication Data
US 2016/0152443 A1 Jun. 2, 2016

(51) Int. Cl.
*B66B 7/06* (2006.01)
*B66B 9/00* (2006.01)
(Continued)

(52) U.S. Cl.
CPC ..... *B66B 7/06* (2013.01); *B66B 9/00* (2013.01); *D07B 1/144* (2013.01); *D07B 1/165* (2013.01);
(Continued)

(58) Field of Classification Search
CPC .. B66B 7/06; B66B 9/00; D07B 1/165; D07B 5/007; D07B 2201/2055; D07B 2501/2007
(Continued)

(56) References Cited

U.S. PATENT DOCUMENTS 1,811,697 A * 6/1931 Reilly ..... D07B 1/0673 57/214
2,241,955 A * 5/1941 Noyer ..... D07B 1/0673 57/214
(Continued)

FOREIGN PATENT DOCUMENTS

CN 1802308 A 7/2006
CN 101415880 A 4/2009
(Continued)

OTHER PUBLICATIONS

Combined Office Action and Search Report dated Aug. 30, 2016 in Chinese Patent Application No. 201380077193.4 with partial English translation and English translation of category of cited documents.
(Continued)

*Primary Examiner* — Michael A Riegelman
(74) *Attorney, Agent, or Firm* — Oblon, McClelland, Maier & Neustadt, L.L.P.

(57) ABSTRACT

In an elevator rope, an inner layer rope includes: a plurality of steel inner layer strands; and a resin inner layer rope coating body that is coated onto an outer circumference. A plurality of outer layer strands are twisted together on an outer circumference of the inner layer rope. The outer layer strands each include: an outer layer strand fiber core; and a plurality of steel wires that are twisted together on an outer circumference of the outer layer strand fiber core.

10 Claims, 5 Drawing Sheets

(51) Int. Cl.
*D07B 1/16* (2006.01)
*D07B 1/14* (2006.01)
*D07B 5/00* (2006.01)

(52) U.S. Cl.
CPC ..... *D07B 5/007* (2013.01); *D07B 2201/2023* (2013.01); *D07B 2201/2055* (2013.01); *D07B 2201/2058* (2013.01); *D07B 2201/2076* (2013.01); *D07B 2501/2007* (2013.01)

(58) Field of Classification Search
USPC ..... 187/254
See application file for complete search history.

(56) References Cited

U.S. PATENT DOCUMENTS

| | | | | | |
|---|---|---|---|---|---|
| 3,104,515 | A * | 9/1963 | Stevens | D07B 1/068 | 57/220 |
| 3,705,489 | A | 12/1972 | Smollinger | | |
| 3,874,158 | A * | 4/1975 | Chiappetta | D07B 1/0686 | 57/214 |
| 4,050,230 | A * | 9/1977 | Senoo | D07B 1/025 | 57/231 |
| 4,120,145 | A | 10/1978 | Chiappetta et al. | | |
| 4,219,995 | A * | 9/1980 | Tajima | D07B 1/068 | 57/213 |
| 4,226,078 | A * | 10/1980 | Ohta | D07B 1/068 | 57/213 |
| 4,809,492 | A * | 3/1989 | Fischer | D07B 1/02 | 57/212 |
| 5,566,786 | A * | 10/1996 | De Angelis | B66B 7/06 | 187/266 |
| 5,881,843 | A * | 3/1999 | O'Donnell | B66B 7/06 | 187/254 |
| 6,314,711 | B1 * | 11/2001 | De Angelis | B66B 7/06 | 57/210 |
| 6,321,520 | B1 * | 11/2001 | De Angelis | D07B 1/025 | 57/211 |
| 6,412,264 | B1 * | 7/2002 | De Josez | B66B 7/06 | 57/217 |
| 6,563,054 | B1 * | 5/2003 | Damien | D07B 1/165 | 174/120 C |
| 2004/0016603 | A1 * | 1/2004 | Aulanko | B66B 7/06 | 187/254 |
| 2004/0026178 | A1 * | 2/2004 | Honda | B66B 7/06 | 187/251 |
| 2008/0236130 | A1 * | 10/2008 | Furukawa | D07B 1/0673 | 57/212 |
| 2011/0192131 | A1 * | 8/2011 | Naito | B66B 7/06 | 57/232 |
| 2012/0180926 | A1 * | 7/2012 | Rebouillat | D02G 3/48 | 152/527 |
| 2013/0227926 | A1 * | 9/2013 | Amils | D07B 1/068 | 57/218 |
| 2014/0311119 | A1 * | 10/2014 | Mitsui | B66B 7/06 | 57/216 |
| 2014/0374195 | A1 * | 12/2014 | Deconinck | D07B 1/0673 | 187/254 |
| 2015/0144432 | A1 * | 5/2015 | Mitsui | D07B 1/0673 | 187/254 |
| 2015/0247285 | A1 * | 9/2015 | Amils | D07B 1/005 | 57/221 |

FOREIGN PATENT DOCUMENTS

| | | | | |
|---|---|---|---|---|
| CN | 201553934 | U | 8/2010 | |
| CN | 103189296 | A | 7/2013 | |
| EP | 2 055 829 | A1 | 5/2009 | |
| EP | 2055829 | A1 * | 5/2009 | B66B 7/06 |
| EP | 2 441 723 | A1 | 4/2012 | |
| JP | 48-94953 | | 11/1973 | |
| JP | 6-322680 | A | 11/1994 | |
| JP | 7-43870 | U | 9/1995 | |
| JP | 2992783 | B2 | 12/1999 | |
| JP | 2003 292270 | A | 10/2003 | |
| JP | 2011-46462 | A | 3/2011 | |
| JP | 2013-32190 | A | 2/2013 | |
| WO | 2008/023434 | A1 | 2/2008 | |
| WO | 2010/143249 | A1 | 12/2010 | |

OTHER PUBLICATIONS

International Search Report dated Sep. 24, 2013 in PCT/JP13/068737 Filed Jul. 9, 2013.
Combined Office Action and Search Report dated Apr. 27, 2017 in Chinese Patent Application No. 201380077193.4 (with partial English translation and English translation of categories of cited documents).
Extended European Search Report dated Jul. 12, 2017 in European Patent Application 13889056.
Office Action dated Oct. 31, 2017. in Chinese Patent Application No. 201380077193.4 (with English translation ).

* cited by examiner

ELEVATOR ROPE AND ELEVATOR APPARATUS THAT USES SAME

TECHNICAL FIELD

The present invention relates to an elevator rope in which a resin inner layer rope coating body is coated onto an outer circumference of an inner layer rope, and in which a plurality of outer layer strands are twisted together on an outer circumference of the inner layer rope coating body, and to an elevator apparatus that uses the same.

BACKGROUND ART

In conventional elevator ropes, a core rope is disposed centrally. The core rope is configured by twisting three core rope strands together with each other. Each of the core rope strands is constituted by a number of yarns that are formed by bundling fibers. An outer circumference of the core rope is coated by a resin core rope coating body. A plurality of steel strands are twisted together on an outer circumference of the core rope coating body. Each of the steel strands is formed by twisting together a plurality of steel wires (see Patent Literature 1, for example).

CITATION LIST

Patent Literature

[Patent Literature 1]
International Publication No. (WO) 2010/143249

SUMMARY OF THE INVENTION

Problem to be Solved by the Invention

In conventional elevator ropes such as that described above, if rope grease is impregnated into the core rope, the rope grease is supplied to the steel strands through minute cracks that form in the core rope coating body due to a long period of use. For this reason, the rope grease cannot be expected to permeate out of the core rope in the early stages of use of the elevator rope.

The present invention aims to solve the above problems and an object of the present invention is to provide an elevator rope that can maintain lubricity by rope grease over a long period from an early stage of use, and an elevator apparatus that uses the same.

Means for Solving the Problem

In order to achieve the above object, according to one aspect of the present invention, there is provided an elevator rope including: an inner layer rope that includes: a plurality of steel inner layer strands; and a resin inner layer rope coating body that is coated onto an outer circumference; and a plurality of outer layer strands that are twisted together on an outer circumference of the inner layer rope, wherein the outer layer strands each include: an outer layer strand fiber core; and a plurality of steel wires that are twisted together on an outer circumference of the outer layer strand fiber core.

According to another aspect of the present invention, there is provided an elevator apparatus including: a hoisting machine that includes a sheave; an elevator rope that is wound onto the driving sheave; and a car that is suspended by the elevator rope, and that is raised and lowered by the hoisting machine, wherein: the elevator rope includes: an inner layer rope that includes: a plurality of steel inner layer strands; and a resin inner layer rope coating body that is coated onto an outer circumference; and a plurality of outer layer strands that are twisted together on an outer circumference of the inner layer rope; and the outer layer strands each include: an outer layer strand fiber core; and a plurality of steel wires that are twisted together on an outer circumference of the outer layer strand fiber core.

Effects of the Invention

In an elevator rope, and in an elevator apparatus that uses the same, according to the present invention, because the inner layer rope coating body is disposed around the outer circumference of the inner layer rope, and the outer layer strand fiber cores are also disposed on the outer layer strands, portions of the inner layer rope inside the inner layer rope coating body can be impregnated with rope grease, and the outer layer strand fiber cores can also be impregnated with rope grease. Because of that, the rope grease in the outer layer strand fiber cores is supplied to the wires of the outer layer strands in early stages of use, and the rope grease can be supplied to the wires in the outer layer strands through cracks in the inner layer rope coating body after the cracks form due to a long period of use, enabling the lubricity by the rope grease to be maintained over a long period from an early stage of use.

DESCRIPTION OF EMBODIMENTS

Preferred embodiments of the present invention will now be explained with reference to the drawings.

Embodiment 1

Figure 1:
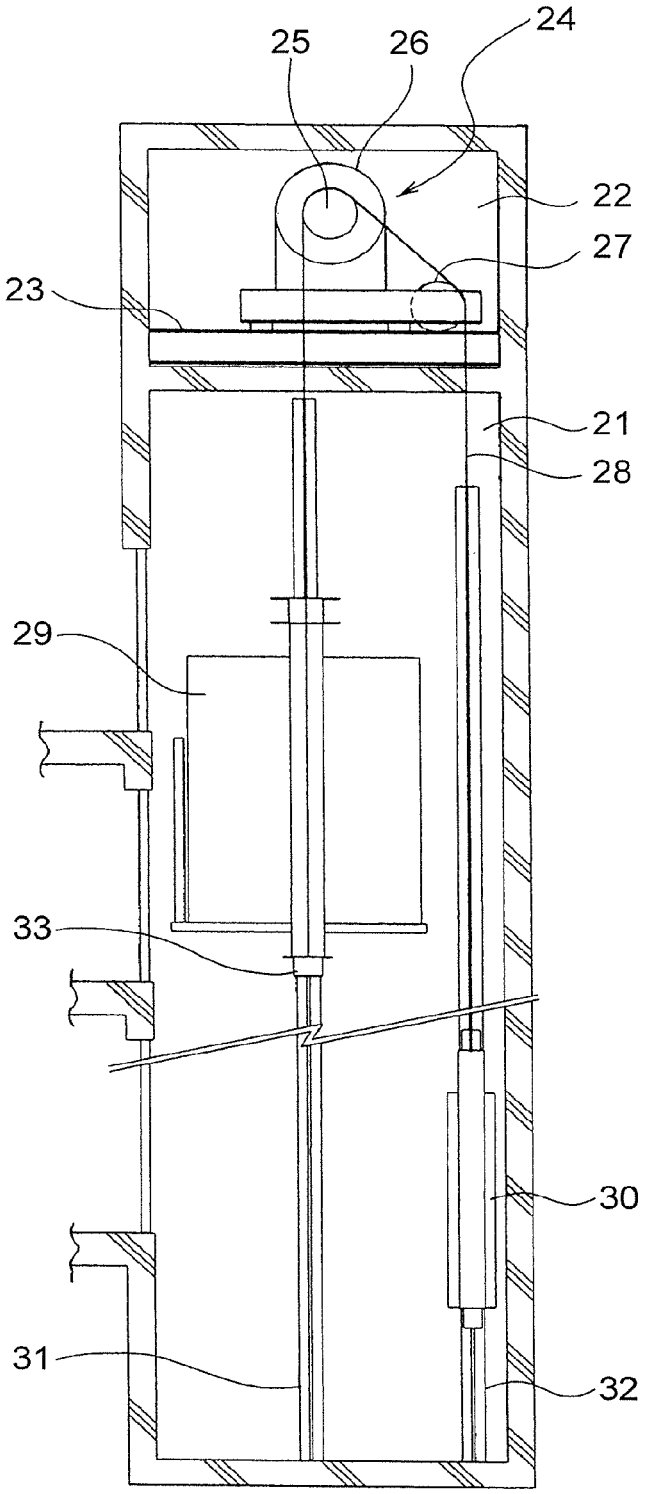
FIG. 1 is a configuration diagram that shows an elevator apparatus according to Embodiment 1 of the present invention.

FIG. 1 is a configuration diagram that shows an elevator apparatus according to Embodiment 1 of the present invention. In the figure, a machine room 22 is disposed in an upper portion of a hoistway 21. A machine base 23 is installed inside the machine room 22. A hoisting machine 24 is supported on the machine base 23. The hoisting machine 24 has a sheave 25 and a hoisting machine main body 26. The hoisting machine main body 26 has: a hoisting machine motor that rotates the sheave 25; and a hoisting machine brake that brakes the rotation of the sheave 25.

A deflecting sheave 27 is mounted onto the machine base 23. A plurality of elevator ropes 28 (only one is shown in the figure) that function as a suspending body are wound around the sheave 25 and the deflecting sheave 27. Rope grooves into which the elevator ropes 28 are inserted are formed on an outer circumference of the sheave 25.

A car 29 and a counterweight 30 are suspended inside the hoistway 21 by the elevator ropes 28 so as to be raised and lowered inside the hoistway 21 by the hoisting machine 24. A pair of car guide rails 31 that guide raising and lowering of the car 29 and a pair of counterweight guide rails 32 that guide raising and lowering of the counterweight 30 are installed inside the hoistway 21. A safety device 33 that makes the car 29 perform an emergency stop by engaging with the car guide rail 31 is mounted onto the car 29.

Figure 2:
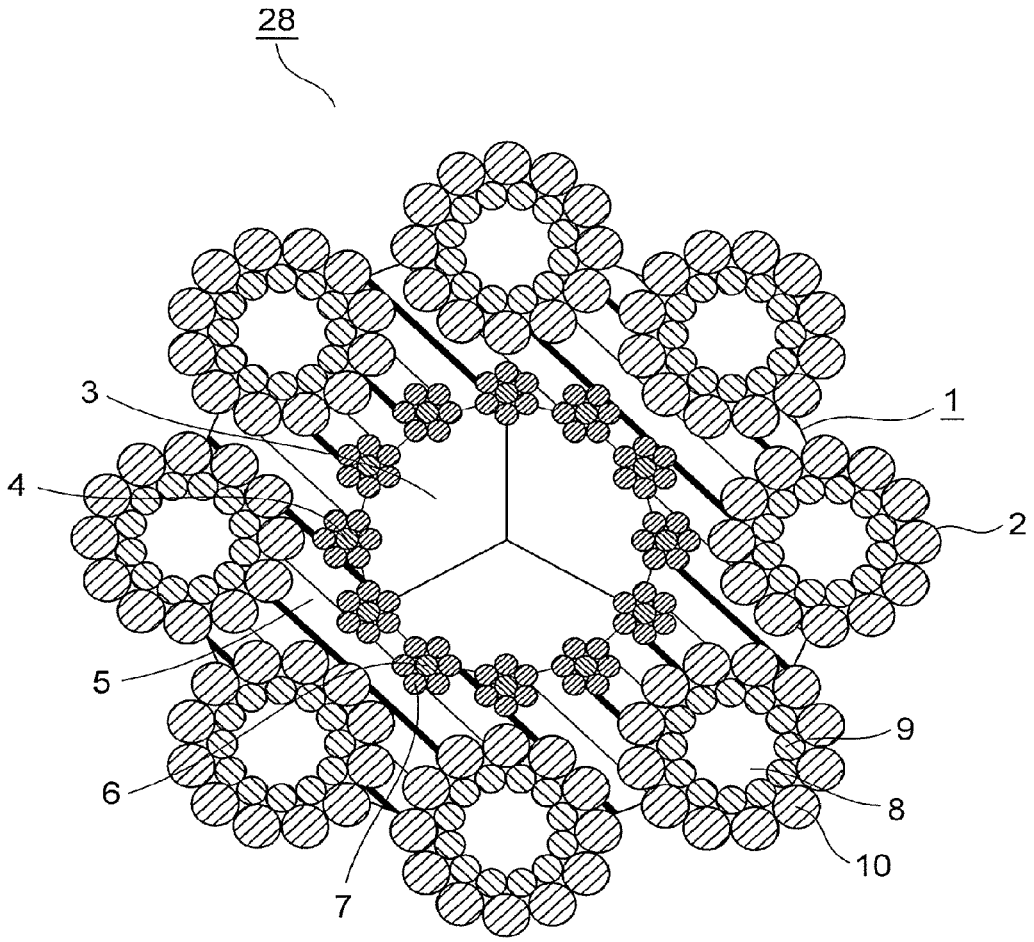
FIG. 2 is a cross section of an elevator rope from FIG. 1.

FIG. 2 is a cross section of an elevator rope 28 from FIG. 1. The elevator rope 28 has: an inner layer rope 1; and a plurality of outer layer strands 2 that are twisted together on an outer circumference of the inner layer rope 1. The outer layer strands 2 are positioned in an outermost layer of the elevator rope 28 so as to be exposed externally.

The inner layer rope 1 has: an inner layer rope fiber core 3 that is disposed centrally; a plurality of inner layer strands 4 that are twisted together directly onto an outer circumference of the inner layer rope fiber core 3; and a resin inner layer rope coating body 5 that is coated onto an outer circumference.

A synthetic fiber twisted core that is made of polypropylene or polyethylene, for example, is used as the inner layer rope fiber core 3. The inner layer rope fiber core 3 is configured by twisting together three core strands 2 and applying pressure from the outer circumference. Each of the core strands is constituted by a number of yarns that are formed by bundling synthetic fibers. In addition, rope grease is impregnated into the inner layer rope fiber core 3.

Each of the inner layer strands 4 is configured by twisting together a plurality of steel wires. More specifically, each of the inner layer strands 4 has a two-layer construction that has: an inner layer strand core wire 6 that is disposed centrally; and a plurality of (in this case, six) inner layer strand outer layer wires 7 that are twisted together on an outer circumference of the inner layer strand core wire 6. A diameter of the inner layer strand core wire 6 is similar or identical to a diameter of the inner layer strand outer layer wires 7.

A diameter of the inner layer strands 4 is smaller than a diameter of the outer layer strands 2. In this case, the diameter of the inner layer strands 4 is less than or equal to one third of the diameter of the outer layer strands 2. Furthermore, the inner layer strands 4 are greater in number than the outer layer strands 2. In this case, twelve inner layer strands 4 are used, compared to eight outer layer strands 2.

A resin that has a certain amount of hardness, such as polyethylene or polypropylene, for example, is used as a material for the inner layer rope coating body 5. The inner layer rope coating body 5 is interposed between adjacent outer layer strands 2, between adjacent inner layer strands 4, and also between the outer layer strands 2 and the inner layer strands 4.

Each of the outer layer strands 2 has a three-layer construction that has: an outer layer strand fiber core 8 that is disposed centrally; a plurality of outer layer strand intermediate wires 9 that are twisted together on an outer circumference of the outer layer strand fiber core 8; and a plurality of outer layer strand outer layer wires 10 that are twisted together on an outer circumference of the layer of outer layer strand intermediate wires 9. Furthermore, the outer layer strand intermediate wires 9 are equal in number to the outer layer strand outer layer wires 10 (in this case, twelve of each).

Synthetic fiber twisted cores that are made of polypropylene or polyethylene, for example, are used as the outer layer strand fiber cores 8. The outer layer strand fiber cores 8 are constituted by a number of yarns that are formed by bundling synthetic fibers. In addition, rope grease is impregnated into the outer layer strand fiber cores 8.

A diameter of the outer layer strand intermediate wires 9 is smaller than a diameter of the outer layer strand outer layer wires 10. A diameter of the outer layer strand fiber cores 8 is larger than the diameter of the outer layer strand outer layer wires 10. The diameters of the wires 6 and 7 that are included in the inner layer strands 4 are smaller than the diameters of any of the wires 9 and 10 that are included in the outer layer strands 2.

In an elevator rope 28 of this kind, because the inner layer rope coating body 5 is disposed around the outer circumference of the inner layer rope 1, and the outer layer strand fiber cores 8 are also disposed on the outer layer strands 2, portions inside the inner layer rope coating body 5 can be impregnated with rope grease, and the outer layer strand fiber cores 8 can also be impregnated with rope grease. Because of that, the rope grease in the outer layer strand fiber cores 8 is supplied to the wires 9 and 10 of the outer layer strands 2 in early stages of use, and the rope grease can be supplied to the wires 9 and 10 in the outer layer strands 2 through cracks in the inner layer rope coating body 5 after the cracks form due to a long period of use, enabling the lubricity by the rope grease to be maintained over a long period from an early stage of use.

Because the inner layer rope fiber core 3 is disposed centrally in the inner layer rope 1, sufficient rope grease can be impregnated inside the inner layer rope coating body 5.

In addition, because the diameters of the inner layer strands 4 that are disposed on the outer circumference of the inner layer rope fiber core 3 are sufficiently smaller than the diameters of the outer layer strands 2, sufficient cross-sectional area of the inner layer rope fiber core 3 can be ensured, enabling rope grease content to be sufficiently ensured.

Because the inner layer strands 4, which are greater in number than the outer layer strands 2, are disposed on the outer circumference of the inner layer rope fiber core 3, the inner layer rope fiber core 3 is protected by the inner layer strands 4 during molding of the inner layer rope coating body 5, preventing the fibers of the inner layer rope fiber core 3 from melting and breaking.

In addition, because the inner layer rope fiber core 3 is tightened when the inner layer strands 4 are twisted together, structural gaps inside the inner layer rope fiber core 3 are reduced significantly, enabling reductions in diameter due to deformation (loss of resilience) of the inner layer rope 1 over periods of extended use and increases in contact pressure between the outer layer strands 2 resulting therefrom to be prevented, thereby enabling wire abrasion of the outer layer strands 2 to be prevented. Thus, additional extension of service life of the elevator ropes 28 can be achieved.

Furthermore, because the inner layer rope fiber core 3 is disposed centrally, there are no steel strands that are not twisted together with other strands. In other words, all of the strands 2 and 4 are twisted together with the other strands 2 and 4 without exception. Because of that, wire breakages and loosening of the wires 6, 7, 9, and 10 are less likely to occur, enabling extension of service life of the entire rope to be achieved.

By applying a resin such as polyethylene or polypropylene, for example, that has self-lubricating properties as the material for the inner layer rope coating body 5, deterioration in strength due to increased wire abrasion resulting from lubrication between the inner layer rope 1 and the outer layer strands 2 deteriorating if the rope grease in the inner layer rope fiber core 3 dries up due to an extended period of use can be suppressed.

In addition, because cross-sectional area of the inner layer strands 4 is reduced and the outer layer strand fiber cores 8 are also disposed on the outer layer strands 2, the present invention can be used instead of elevator ropes in existing elevator apparatuses, for example, without modification without increasing unit mass of the rope unnecessarily.

For example, by giving the inner layer rope 1 a twelve-(number of strands) by-seven (number of wires) construction, and making the number of the outer layer strands 2 eight, and the number of wires in each of the outer layer strands 2 twenty-four, as shown in FIG. 1, the increase in unit mass due to the inner layer strands 4 can be kept to within five percent compared when the portions in the inner layer strands 4 are also occupied by the inner layer rope fiber core 3.

Now, when minute cracks arise in the inner layer rope coating body 5 due to an extended period of use, the rope grease is supplied to the outer layer strands 2 through the cracks. In contrast to that, if the thickness of the inner layer rope coating body 5 were too great, the rope grease might not be supplied, and the cross-sectional area of the inner layer rope fiber core 3 would be reduced, also reducing rope grease pickup.

In order to prevent direct contact between the inner layer strands 4 and the outer layer strands 2, it is necessary for the inner layer rope coating body 5 to be interposed between the two. However, the thickness of the inner layer rope coating body 5 need only be in the order of one percent of the rope diameter in order to prevent direct contact. Because of that, allowing for manufacturing errors during coating application and laying of the outer layer strands 2, it is preferable for the thickness of the inner layer rope coating body 5 that is interposed between the inner layer strands 4 and the outer layer strands 2 to be greater than or equal to one percent and less than or equal to two percent of an overall diameter of the elevator rope 28.

By using inner layer rope fiber cores 3 that are made of a synthetic resin, gaps inside the inner layer rope fiber cores 3 are reduced compared to natural fibers such as sisal that are commonly used as a core rope material in elevator ropes, further enabling deformation (loss of resilience) to be suppressed over periods of extended use. Corrosion in high-humidity environments can also be suppressed due to characteristics of the material itself, such as not being hydrolyzed. Thus, internal damage that was at risk of arising among the outer layer strands and between the outer layer strands 2 and the inner layer rope 1 can be more reliably prevented.

In addition, the strength of the elevator rope 28 is basically designed so as to be able to support a load even without the inner layer strands 4. However, by making the diameters of the wires 6 and 7 that are included in the inner layer strands 4 smaller than the diameters of any of the wires 9 and 10 that are included in the outer layer strands 2, and setting tensile strength of the wires 6 and 7 that are included in the inner layer strands 4 so as to be greater than tensile strength of any of the wires 9 and 10 that are included in the outer layer strands 2, the inner layer strands 4 are prevented from breaking at an earlier stage than the outer layer strands 2, such that wire breakages arise from the outer layer strands 2, facilitating determination of deterioration of the elevator rope 28 from external appearances.

Embodiment 2

Figure 3:
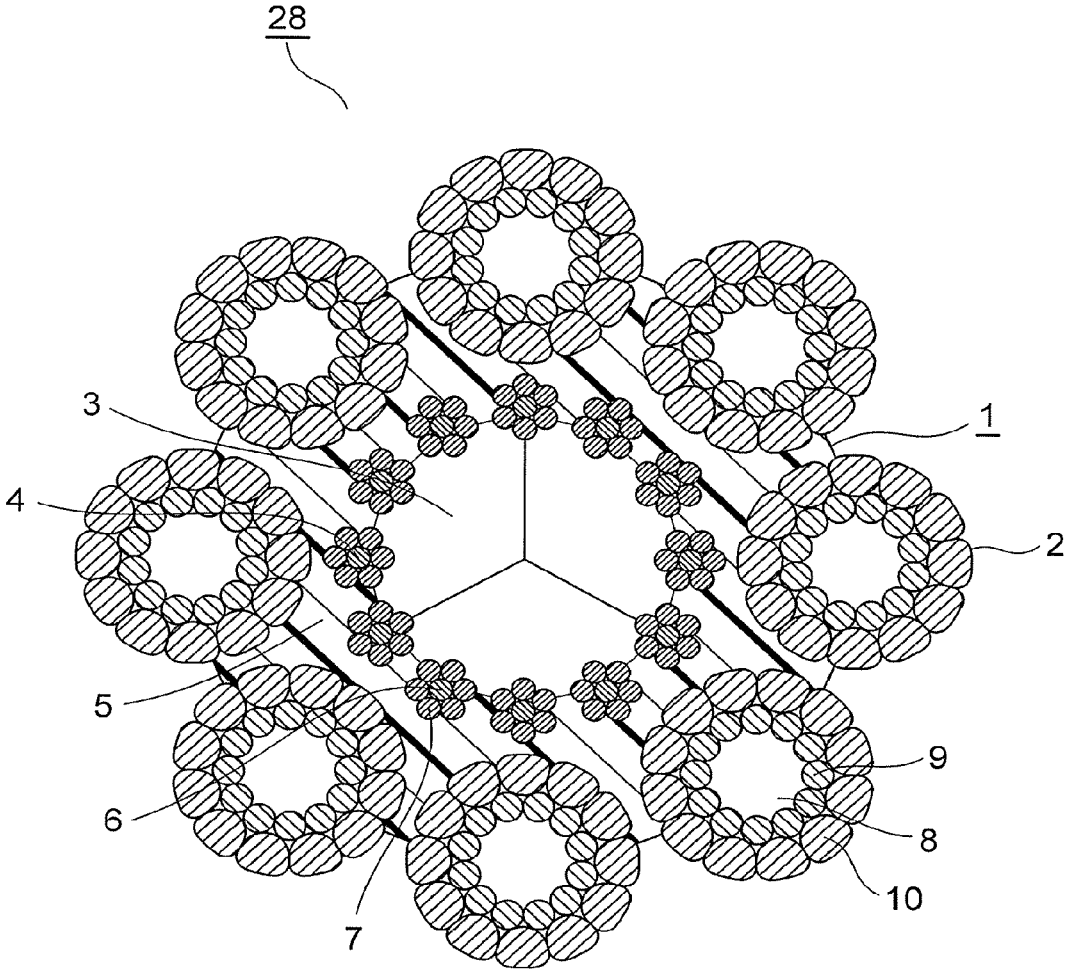
FIG. 3 is a cross section of an elevator rope according to Embodiment 2 of the present invention.

Next, FIG. 3 is a cross section of an elevator rope 28 according to Embodiment 2 of the present invention. In this example, outer layer strands 2 are compressed (by plastic working) from an outer circumference by a die during manufacturing. Cross-sectional shapes of outer layer strand outer layer wires 10 are thereby modified. The rest of the configuration is similar or identical to that of Embodiment 1.

According to a configuration of this kind, contact surface pressure between the rope grooves of the sheave 25 and the elevator rope 28 can be reduced, enabling damage to portions of the outer layer strand outer layer wires 10 that contact the sheave 25 to be suppressed while suppressing internal damage to the elevator rope 28, and enabling additional extension of service life of the elevator rope 28 to be achieved.

Embodiment 3

Figure 4:
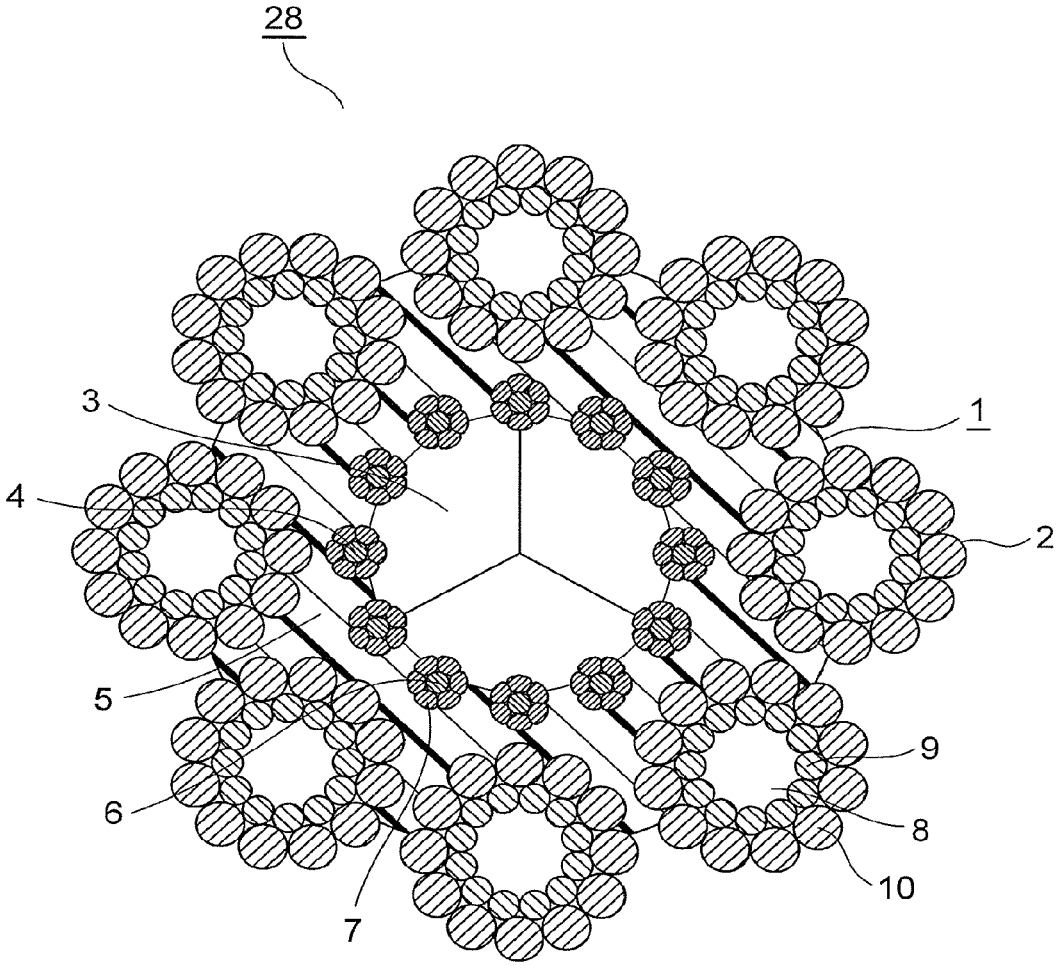
FIG. 4 is a cross section of an elevator rope according to Embodiment 3 of the present invention.

Next, FIG. 4 is a cross section of an elevator rope 28 according to Embodiment 3 of the present invention. In this example, inner layer strands 4 are compressed (by plastic working) from an outer circumference by a die during manufacturing. Cross-sectional shapes of inner layer strand outer layer wires 7 are thereby modified. The rest of the configuration is similar or identical to that of Embodiment 1.

According to a configuration of this kind, even if the inner layer strands 4 happen to contact each other, or the thickness of the inner layer rope coating body 5 becomes thin and the outer layer strands 2 and the inner layer strands 4 contact, additional extension of service life of the elevator ropes 28 can be achieved because the contact surface pressure in such cases can be reduced.

Embodiment 4

Figure 5:
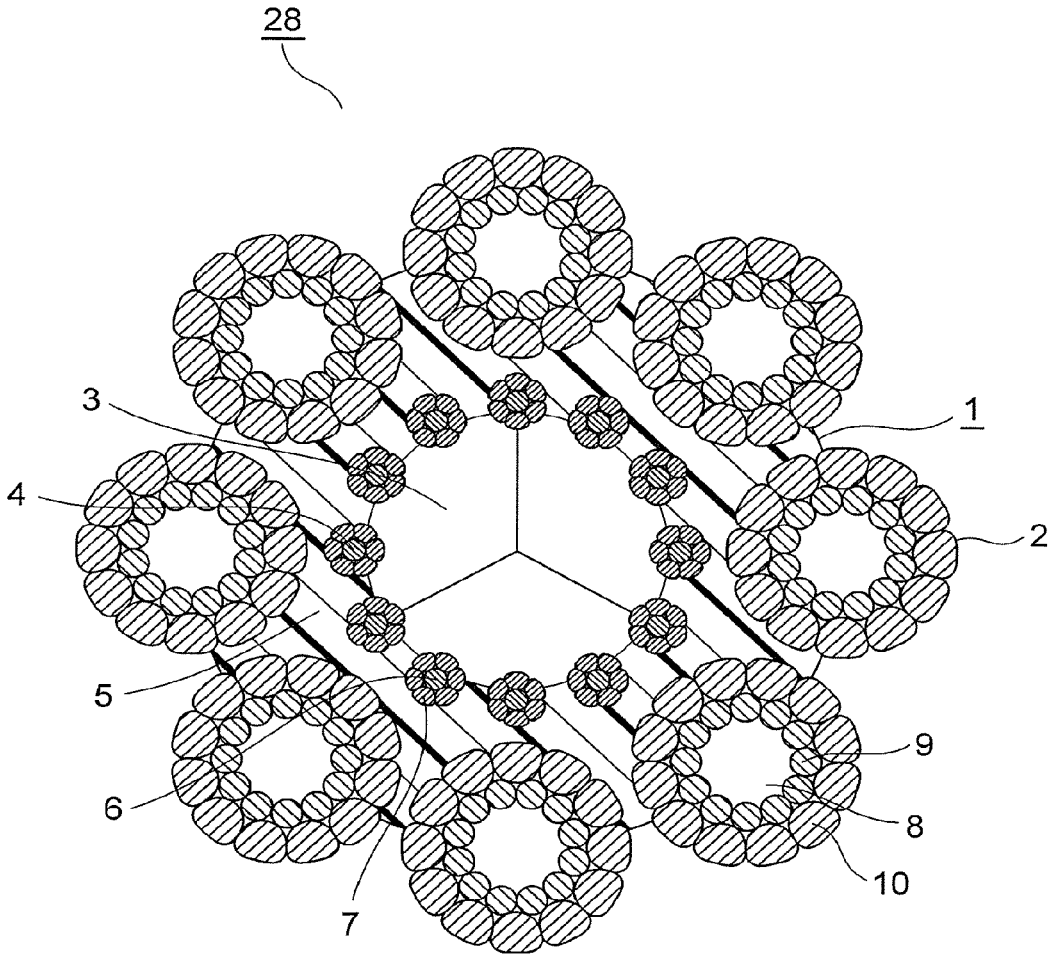
FIG. 5 is a cross section of an elevator rope according to Embodiment 4 of the present invention.

Next, FIG. 5 is a cross section of an elevator rope 28 according to Embodiment 4 of the present invention. Embodiment 4 is a combination of Embodiments 2 and 3. Specifically, in Embodiment 4, cross-sectional shapes of outer layer strand outer layer wires 10 are modified, and cross-sectional shapes of inner layer strand outer layer wires 7 are also modified. The rest of the configuration is similar or identical to that of Embodiment 1.

According to a configuration of this kind, the effects of both Embodiments 2 and 3 can be achieved.

Moreover, a synthetic fiber round bar core (a solid core) that is made of polypropylene or polyethylene, for example, may be used in at least one of the inner layer rope fiber core 3 and the outer layer strand fiber cores 8. Thus, packing density in the core portion is further improved, enabling deformation (loss of resilience) over periods of extended use to be further suppressed, and enabling reductions in diameter and wire abrasion that results therefrom to be further prevented. On the other hand, gaps for impregnating the rope grease are reduced. Because of that, the type of fiber core that is used should be selected so as to allow for required performance such as the amount of rope grease that is required for lubrication, the amount of ambient splattering of rope grease, rope service life, etc. Of course, the possibility of supplementing the rope grease by external addition is also taken into consideration.

The type of elevator apparatus to which the elevator rope according to the present invention is applied is not limited to the type in FIG. 1. The present invention can also be applied to machine-room less elevators, to elevator apparatuses that use two-to-one (2:1) roping methods, to multi-car elevators, or to double-deck elevators, for example.

In addition, the elevator rope according to the present invention can also be applied to ropes other than ropes for suspending a car 29, such as compensating ropes or governor ropes, for example.

The invention claimed is:

1. An elevator rope comprising:

an inner layer rope that includes:

an inner layer roe fiber core;

a plurality of steel inner layer strands twisted together onto an outer circumference of the inner layer rope fiber core; and a resin inner layer rope coating body that is coated onto an outer circumference of the inner layer rope fiber core and the steel inner layer strands; and a plurality of outer layer strands that are twisted together on an outer circumference of the inner layer rope and are separated from the inner layer rope fiber core and inner layer strands of the inner layer rove by the resin inner layer rope coating body, wherein the outer layer strands each include:

an outer layer strand fiber core; and a plurality of steel wires that are twisted together on an outer circumference of the outer layer strand fiber core, wherein a rope grease is impregnated into the outer layer strand fiber core, and wherein a rope grease is impregnated into the inner layer rope fiber core.

2. The elevator rope according to claim 1, wherein the inner layer rope fiber core and the outer layer strand fiber core each comprise synthetic fiber.

3. The elevator rope according to claim 2, wherein at least one of the inner layer rope fiber core and the outer layer strand fiber core is a round bar core.

4. The elevator rope according to claim 1, wherein the inner layer strands are greater in number than the outer layer strands.

5. The elevator rope according to claim 1, wherein a diameter of the inner layer strands is smaller than a diameter of the outer layer strands.

6. The elevator rope according to claim 1, wherein a diameter of a wire that is included in the inner layer rope is smaller than a diameter of any wire that is included in the outer layer strands.

7. The elevator rope according to claim 1, wherein a tensile strength of a wire that is included in the inner layer rope is greater than a tensile strength of any wire that is included in the outer layer strands.

8. The elevator rope according to claim 1, wherein a unit mass of the elevator rope having the steel inner layer strands is within five percent of the unit mass of an elevator rope lacking the steel inner layer strands and where a fiber core occupies the space of the steel inner layer strands.

9. The elevator rope according to claim 1, wherein a thickness of the inner layer rope coating body that is interposed between the inner layer strands and the outer layer strands is greater than or equal to one percent and less than or equal to two percent of an overall rope diameter.

10. An elevator apparatus comprising:

a hoisting machine that includes a sheave;

an elevator rope that is wound onto the sheave; and a car that is suspended by the elevator rope, and that is raised and lowered by the hoisting machine, wherein:

the elevator rope comprises:

an inner layer rope that includes:

an inner layer rope fiber core;

a plurality of steel inner layer strands twisted together onto an outer circumference of the inner layer rope fiber core; and a resin inner layer rope coating body that is coated onto an outer circumference of the inner layer rope fiber core and the inner layer rope; and a plurality of outer layer strands that are twisted together on an outer circumference of the inner layer rope and are separated from the inner layer rope fiber core and inner layer strands of the inner layer rope by the resin inner layer rope coating body; and the outer layer strands each include:

an outer layer strand fiber core; and a plurality of steel wires that are twisted together on an outer circumference of the outer layer strand fiber core, wherein a rope grease is impregnated into the outer layer strand fiber core, and wherein a rope grease is impregnated into the inner layer rope fiber core.

* * * * *